US012186641B2

(12) United States Patent
Feng

(10) Patent No.: US 12,186,641 B2
(45) Date of Patent: Jan. 7, 2025

(54) FOLDABLE FOOTBALL HOLDER

(71) Applicant: Xudong Feng, Ningbo (CN)

(72) Inventor: Xudong Feng, Ningbo (CN)

( * ) Notice: Subject to any disclaimer, the term of this patent is extended or adjusted under 35 U.S.C. 154(b) by 226 days.

(21) Appl. No.: 17/671,963

(22) Filed: Feb. 15, 2022

(65) Prior Publication Data

US 2023/0256314 A1 Aug. 17, 2023

(51) Int. Cl.
*A63B 71/00* (2006.01)
*A63B 69/00* (2006.01)

(52) U.S. Cl.
CPC ..... *A63B 69/0075* (2013.01); *A63B 2210/50* (2013.01); *A63B 2243/007* (2013.01)

(58) Field of Classification Search
CPC ..... A63B 69/0075; A63B 2243/007
USPC ..... 473/419
See application file for complete search history.

(56) References Cited

U.S. PATENT DOCUMENTS 4,946,165 A * 8/1990 Rambacher ..... A63B 69/0075 473/419
5,505,445 A * 4/1996 Treadwell ..... A63B 69/0075 473/419
6,719,650 B1 * 4/2004 Thurlow ..... A63B 69/0075 473/422
8,342,987 B2 * 1/2013 Shaw ..... A63B 69/0075 473/419
10,532,262 B2 * 1/2020 Carney ..... A63B 69/0075 473/419
2005/0124439 A1 * 6/2005 Simon ..... A63B 69/0075 473/420
2023/0256314 A1 * 8/2023 Feng ..... A63B 69/0075 473/419

* cited by examiner

*Primary Examiner* — Mitra Aryanpour
(74) *Attorney, Agent, or Firm* — David & Raymond Patent Firm; Raymond Y Chan

(57) ABSTRACT

A foldable football holder includes at least two elongated supporting arms, an elongated holding arm, and a holder joint. The holder joint is configured to have a secure portion and two pivot wing portions with a predetermined unfolding angle therebetween. A mounting end portion of the holding arm is securely coupled with the secure portion of the holder joint while a holding end portion of the holding arm is extended away from the holder joint in a first direction and the pivot end portions of the two supporting arms are rotatably coupled with the two pivot wing portions of the holder joint about two pivot axes respectively. Each of the two pivot wing portions has a stopper element protruded from an inner surface thereof such that the two stopper elements are arranged to form two stopping walls that selectively limit unfolding rotation of the two supporting arms about the two pivot axes respectively and retain the two supporting arms in the unfolded condition in a second direction, that is perpendicular to the holding arm respectively, while having the predetermined unfolding angle between the two supporting arms.

19 Claims, 11 Drawing Sheets

FOLDABLE FOOTBALL HOLDER

NOTICE OF COPYRIGHT

A portion of the disclosure of this patent document contains material which is subject to copyright protection. The copyright owner has no objection to any reproduction by anyone of the patent disclosure, as it appears in the United States Patent and Trademark Office patent files or records, but otherwise reserves all copyright rights whatsoever.

BACKGROUND OF THE PRESENT INVENTION

Field of Invention

The present invention relates to American football accessory, and more particularly to a foldable football holder which is easy to be folded in a compact size and unfolded to a rigid and strengthened configuration by effectively incorporating holder joint with the supporting arms and the holding arm without complicated supporting mechanism and extra components.

DESCRIPTION OF RELATED ARTS

U.S. Pat. No. 4,946,165, as shown in FIG. 7, discloses a conventional football holder for placing-kicking a NFL type football comprising a base, a support member connected at its lower end to the base, a holding arm pivotally connected at its proximal end to the upper end of the support member for movement about a pivot axis perpendicular to the longitudinal axis of the holding arm, the lower surface of the holding arm at the distal end being adapted to engage a tip of the football. The drawback of this conventional football holder is bulky, heavy and complicated in structure and fails to provide a portable convenience for the user to carry and storage.

U.S. Pat. No. 5,464,209, as shown in FIGS. 8A and 8B, discloses an improved portable football holder which includes two mutually pivotable legs with one leg having an end designed to engage the tip of a football to hold the football in an upright position, and with the other leg being connected to a V-shaped base. The design introduces the concept of folding holding arm but it is still relatively bulky and heavy and the V-shaped base is still constructed unfoldable in order to provide a stable support to the football.

U.S. Pat. No. 8,342,987, as shown in FIGS. 9A and 9B, teaches another conventional football holder which is portable by providing foldable supporting arms as well as holding arm, wherein the football holder is configured to be collapsible and self-assembling but it fails to provide a rigid unfolded configuration to well support the football due to the telescopic, nesting interface arrangement of its tubular supporting arms and holding arm is not an integral rigid body for steadily holding the football in the upright position.

U.S. Pat. No. 10,532,262, as shown in FIG. 10A, provides a compact football holder including a module connecting telescoping legs and football tip telescoping holding arm, with the legs connecting the module for pivoting the legs from a ground engaging position to a transport position beneath and parallel to the arm. It is well known that in order to steadily and easily hold the football in the upright position, it is preferred to provide a slightly downward pressing force by the holding arm against the tip of the football. Similarly to the U.S. Pat. No. 8,432,987, the telescopic configuration of the legs and holding arm of the U.S. Pat. No. 10,532,262 also fails to provide an integral rigid body for steadily holding the football in position. In addition, the pivotal connection between the legs and the module is not a rigid configuration, wherein in order to provide a smooth pivotal rotation of the legs with respect to the module, clearances would be existed at the pivotal connection that renders the total height of the unfolded football holder being difficult to control and failing to provide the downward pressing effect to the football, that increases the effort and time consumed for the football player to position and hold the football in an upright manner. Alternatively, the players have to place the football in an inclined position as shown in FIG. 10B that adversely affects the actual performance of the players.

SUMMARY OF THE PRESENT INVENTION

The invention is advantageous in that it provides a foldable football holder which is easy to be folded into an elongated structure with a compact size and unfolded to a rigid and strengthen configuration.

Another advantage of the invention is to provide a foldable football holder which two supporting arms can be unfolded to an inverted V shape manner with a predetermined angle therebetween to support a holding arm horizontally with the ground where the two supporting arms standing thereon, wherein the two unfolded supporting arms and the holding arm are effectively incorporated with a single body holder joint without equipping complicated supporting mechanism and extra components, such that the structure of holder is simple, the production and material cost of the holder is minimized, and the folding and unfolding of the supporting arms are easy and smooth.

Another advantage of the invention is to provide a holder joint for a foldable football holder which is an integral body configured to have a stopper and secure arrangement which not only can ensure the supporting arms to be unfolded to a predetermined unfolded position precisely by the user, but also provide a secure support effect to hold the two supporting arms in their unfolded position, such that the rigidly mounted holding arm is collaborated with the supporting arms that the football being held in upright position by the holding arm also acting an downward pressure to the holder joint and the supporting arms.

Another advantage of the invention is to provide a holder joint for a foldable football holder which is an integral body configured to have a stopper and secure arrangement which can ensure the supporting arms to be folded to a predetermined folded position precisely by the user wherein the two supporting arms are folded to be parallel with the holding arm precisely to prevent any unwanted contact therebetween that may scratch or cause damages thereto.

Another advantage of the invention is to provide a holder joint for a foldable football holder which is a one-piece integral body allowing the two supporting arms and the holding arm to be incorporated therewith to form a rigid and strengthen configuration to provide rigid and steady support to the football with cost effective material which not only lowers the material cost and manufacturing cost of the football holder, but also allows the user to easily assemble the football holder that enables the user to replace components, such as longer/shorter and lighter/heavier supporting arm or holding arm, anytime by himself or herself to form a desired combination and configuration to fit his or her use while further reducing the selling price of the football holder.

Another advantage of the invention is to provide a foldable football holder, wherein the holder joint is integrally made and configured to fasten the holding arm in position securely and detachably without additional fastening means such as welding nor connecting, while the pair of supporting arm can be fastened to the holder joint in a detachable and rotatable manner.

Additional advantages and features of the invention will become apparent from the description which follows, and may be realized by means of the instrumentalities and combinations particular point out in the appended claims.

According to the present invention, the foregoing and other objects and advantages are attained by a foldable football holder, comprising:

at least two elongated supporting arms, each having a support end portion and a pivot end portion;

an elongated holding arm, having a holding end portion and a mounting end portion; and a holder joint, having a general V-shaped configuration, configured to have a secure portion and two pivot wing portions integrally extended from two opposing sides of the secure portion respectively with a predetermined unfolding angle therebetween, wherein the mounting end portion of the holding arm is securely coupled with the secure portion of the holder joint while the holding end portion of the holding arm is extended away from the holder joint in a first direction and the pivot end portions of the two supporting arms are rotatably coupled with the two pivot wing portions of the holder joint about two pivot axes respectively in such a manner that the two supporting arms are capable of selectively rotating about the two pivot axes to a folded condition that the support end portions of the two supporting arms are extended towards the first direction and to a unfolded condition that the support end portions of the two supporting arms are extended towards a second direction while having the unfolding angle between the two supporting arms, wherein each of the two pivot wing portions has a stopper element protruded from an inner surface thereof such that the two stopper elements of the two pivot wings are respectively extended towards each other from the inner surfaces of the two pivot wing portions, wherein the two stopper elements are arranged to form two stopping walls that selectively limit unfolding rotation of the two supporting arms about the two pivot axes respectively and retain the two supporting arms in the unfolded condition in the second direction, that is perpendicular to the holding arm respectively, while having the predetermined unfolding angle between the two supporting arms.

In one embodiment, the two stopper elements of the two pivot wing portions of the holder joint are further arranged to limit folding rotation of the two supporting arms respectively and retain the two supporting arms in the folded condition along the first direction.

In one embodiment, the two stopper elements of the two pivot wing portions of the holder joint are arranged in such a manner that when the two unfolded supporting arms are placed on a playground and the holding arm is extended transversely for holding a football between the holder end portion thereof and the playground, a downward reaction force applied to the holding arm substantially exerts a pressing pressure against the two supporting arms that secures the unfolded condition of the two supporting arms to be retained by the two stopper elements. The more downward pressure applied to the holding arm, the more secure and rigid is the unfolding configuration of the two supporting arms and the holding arm.

In one embodiment, the two stopper elements of the two pivot wing portions of the holder joint are arranged in such a manner that when the supporting arms are folded about the two pivot axes by rotating towards the holding arm, the two stopper elements form a stopper to stop the rotation of the two supporting arms that prevents the two supporting arms from over rotation to contact with the holding arm and to retain the two supporting arms in the folded condition that are generally parallel with the holding arm.

In one embodiment, each of the two stopper elements has a stopper surface, a first length extended from the inner surface of the pivot wing to a distal end thereof, and a second length extended between two sides of the stopper element, such that the two supporting arms are capable of rotating about a pivot axis between the folded condition and the unfolded condition with respect to the two pivot wing portions of the holder joint respectively, wherein when the two supporting arms are unfolded to the unfolded condition, a first side of each of the two supporting arms is stopped and biased against the stopper surface of the corresponding stopper element. In one embodiment, the second length of each of the stopper elements is predetermined to a distance between the holding arm and the two supporting arms in the folded condition where the two supporting arms are rotated and folded to be parallel with the holding arm, so that when the two supporting arms are folded to the folded condition, one side of the stopper element substantially limits the rotation of the corresponding supporting arm about the pivot axis and retains the corresponding supporting arm in parallel with the holding arm.

In one embodiment, the two pivot end portions of the two supporting arms are pivotally coupled with the two pivot wing portions of the holder joint respectively in a detachable manner so that the users may assemble, disassemble and replace the supporting arm by themselves.

In one embodiment, the mounting end portion of the holding arm is securely coupled with the secure portion of the holder joint in a detachable manner so that the users may assemble, disassemble and replace the holding arm by themselves.

In accordance with another aspect of the invention, the present invention comprises a method of operating a foldable football holder, comprising:

pivotally moving two supporting arms, which are folded in a first direction generally parallel to a holding arm securely coupled to a holder joint, away from the holding arm to unfold the two supporting arms until two pivot end portions of the two supporting arms pivotally, until the pivot end portions of the two supporting arms are limited and stopped by the two stopping elements respectively, to an unfolded position that the two supporting arms are extended in a second direction, generally perpendicular to the holding arm with a predetermined unfolding angle defined between the two supporting arms, such that the two supporting arms are in an inverted V-shape and adapted to place on a playground while the holding arm is transversely extended parallel to the playground for holding a football between a holder end portion of the holding arm and the playground, wherein a downward reaction force applied to the holding arm substantially exerts a pressing pressure against the two supporting arms that secures the unfolded condition of the two supporting arms to be retained by the two stopper elements; and pivotally moving the two supporting arms from the unfolded condition towards the holding arm until the two supporting arms are in the first direction, generally parallel to the holding arm, so as to folded the two supporting arms back to the folded condition for ease of storage and carrying.

Still further objects and advantages will become apparent from a consideration of the ensuing description and drawings.

These and other objectives, features, and advantages of the present invention will become apparent from the following detailed description, the accompanying drawings, and the appended claims.

Figure 1A:
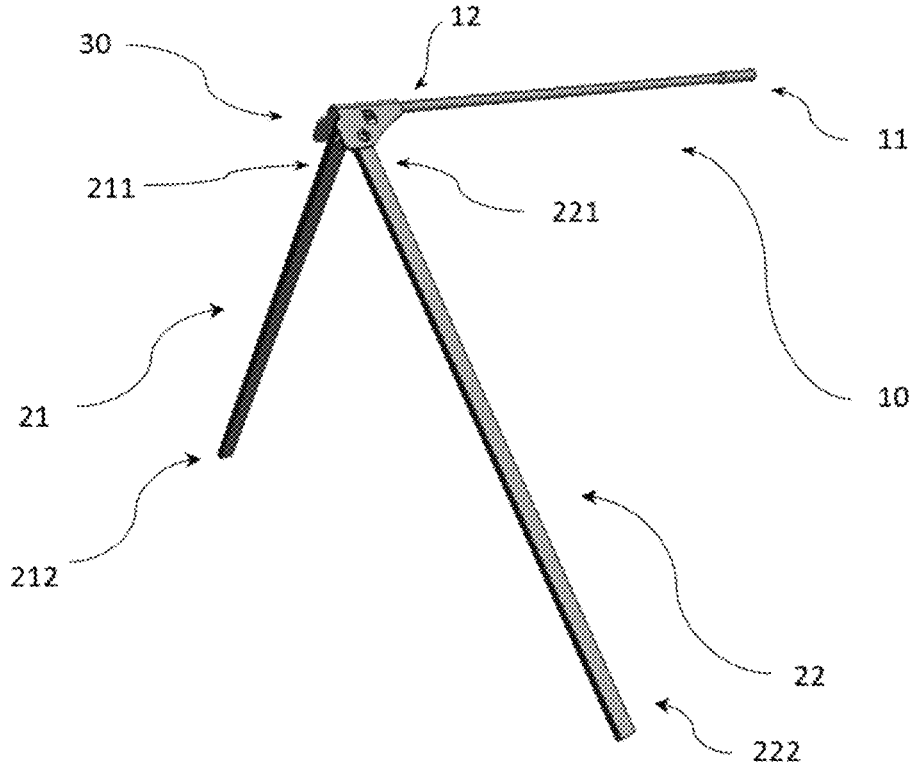
FIG. 1A is a perspective view of a foldable football holder in an unfolded condition according to a first preferred embodiment of the present invention.

The drawings, described above, are provided for purposes of illustration, and not of limitation, of the aspects and features of various examples of embodiments of the invention described herein. The drawings are not intended to limit the scope of the claimed invention in any aspect. For simplicity and clarity of illustration, elements shown in the drawings have not necessarily been drawn to scale and the dimensions of some of the elements may be exaggerated relative to other elements for clarity.

DETAILED DESCRIPTION OF THE PREFERRED EMBODIMENT

The following description is disclosed to enable any person skilled in the art to make and use the present invention. Preferred embodiments are provided in the following description only as examples and modifications will be apparent to those skilled in the art. The general principles defined in the following description would be applied to other embodiments, alternatives, modifications, equivalents, and applications without departing from the spirit and scope of the present invention.

It will be appreciated that numerous specific details are set forth in order to provide a thorough understanding of the exemplary embodiments described herein. However, it will be understood by those of ordinary skill in the art that the embodiments described herein may be practiced without these specific details. In other instances, well-known methods, procedures and components have not been described in detail so as not to obscure the embodiments described herein. Further, this description is not to be considered as limiting the scope of the embodiments described herein in any way, but rather as merely describing implementation of the one or more embodiments described herein.

Referring to FIGS. 1A to 2F, a foldable football holder according to a first preferred embodiment of the present invention is illustrated. The foldable football holder comprises an elongated holding arm 10, at least two elongated supporting arms 21, 22 and a holder joint 30. The holding arm 10 has a holding end portion 11 and a mounting end portion 12. Each of the two elongated supporting arms 21, 22 has a support end portion 211, 221 and a pivot end portion 212, 222.

Figure 2A:
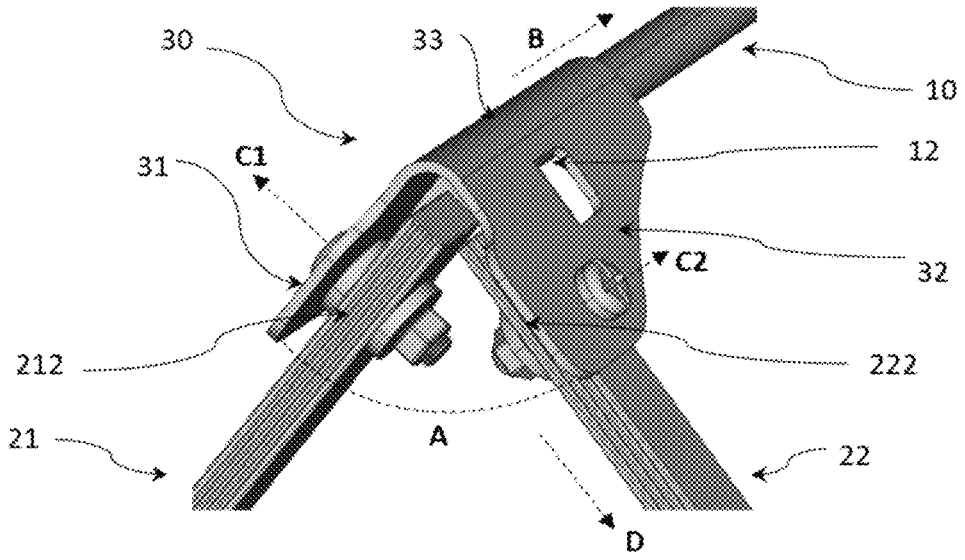
FIGS. 2A-2E are partial perspective views in different viewing angle illustrating the foldable football holder in the unfolded condition according to the above first preferred embodiment of the present invention.
Figure 2B:
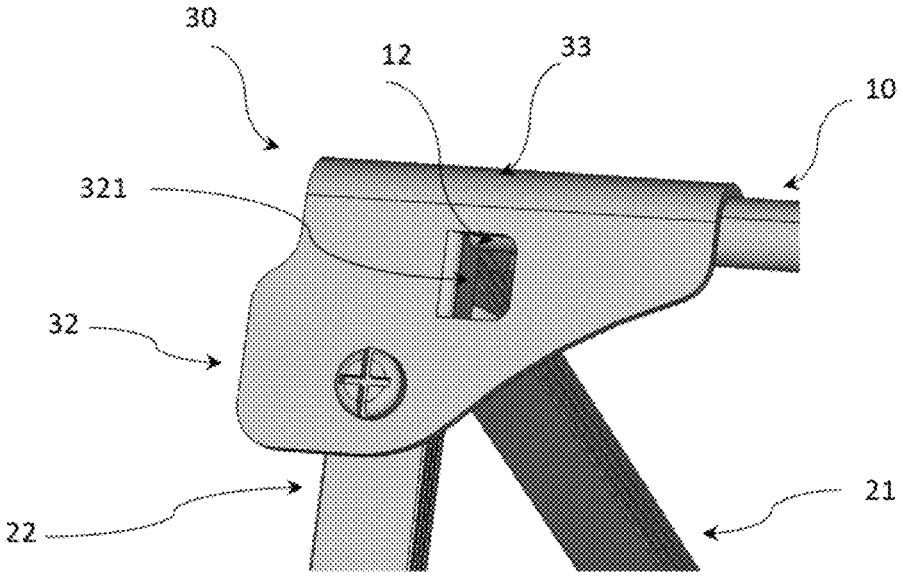

Referring to FIG. 2A, the holder joint 30, having a general V-shaped configuration, is an integral body configured to have two pivot wing portions 31, 32 and a secure portion 33, wherein the two pivot wing portions 31, 32 are integrally extended from two opposing sides of the secure portion 33 respectively with a predetermined unfolding angle A therebetween. The mounting end portion 12 of the holding arm 10 is securely coupled with the secure portion 33 of the holder joint 30 while the holding end portion 11 of the holding arm 10 is extended away from the holder joint 30 in a first direction B and the pivot end portions 212, 222 of the two supporting arm 20 are rotatably coupled with the two pivot wing portions 31, 32 of the holder joint 30 about two pivot axes C1, C2 respectively in such a manner that the two supporting arms 20 are capable of selectively rotating about the two pivot axes C1, C2 to a folded condition that the support end portions 212, 222 of the two supporting arms 21, 22 are extended towards the first direction B and to a unfolded condition that the support end portions 211, 221 of the two supporting arms 21, 22 are extended towards a second direction D while having the unfolding angle A between the two supporting arms 21, 22.

Figure 2C:
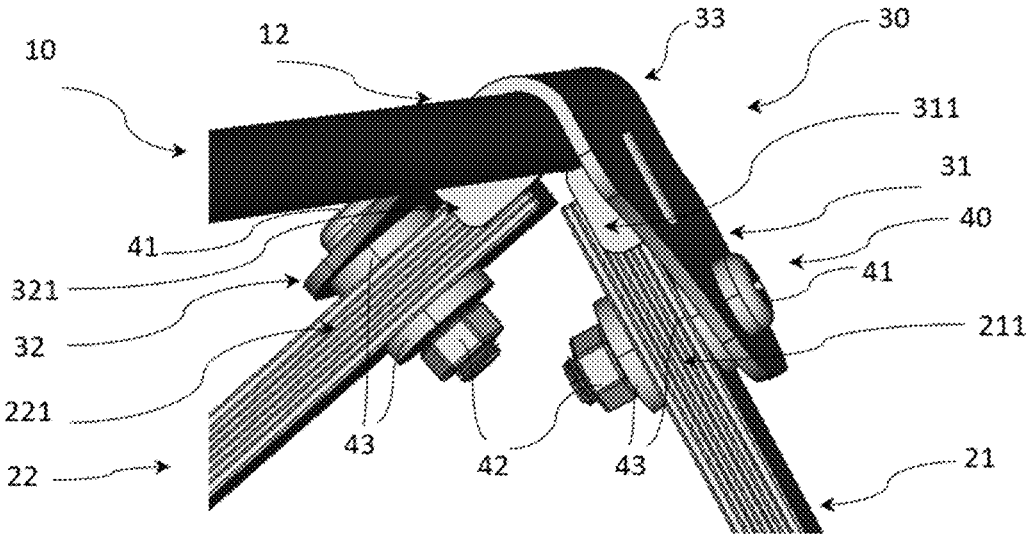
Figure 2D:
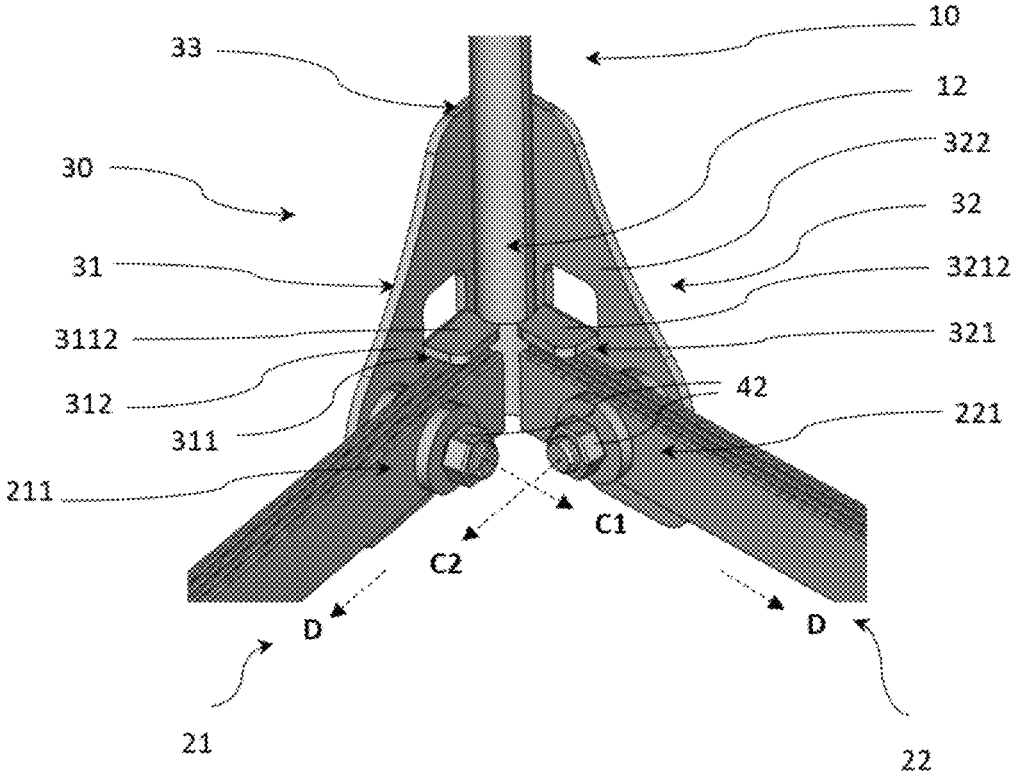
Figure 2E:
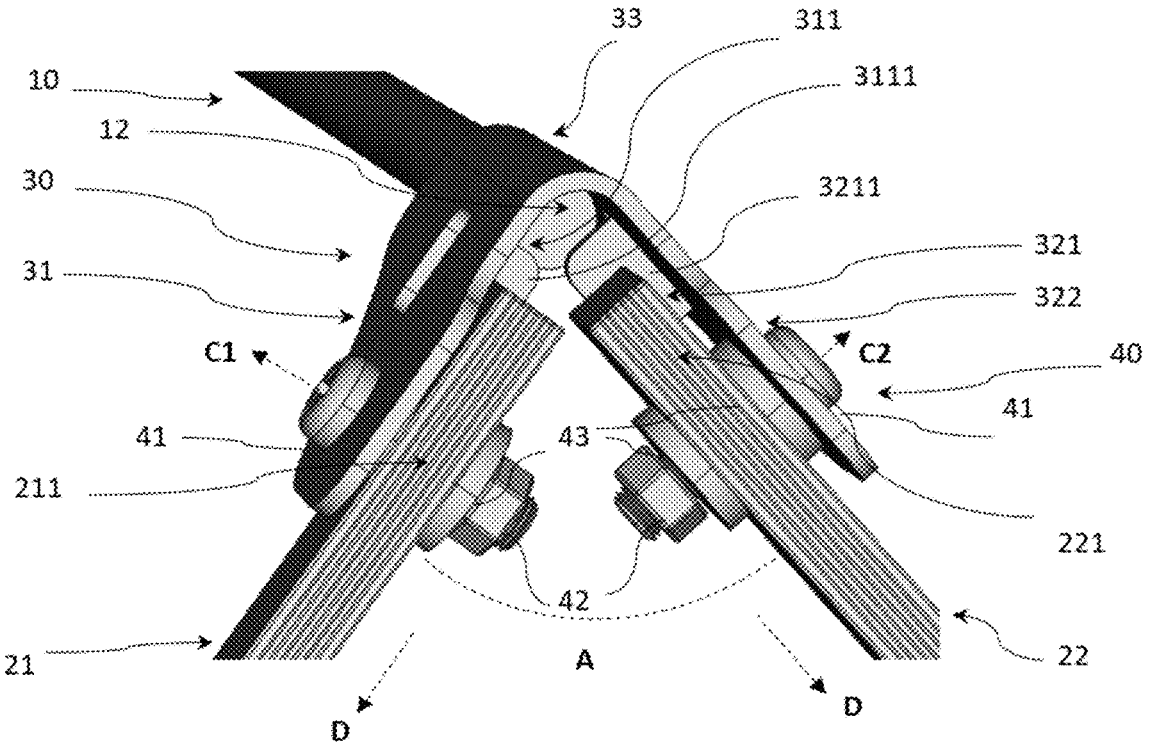

Referring to FIGS. 2A to 2E, each of the two pivot wing portions 31, 32 has a stopper element 311, 321 protruded from an inner surface 312, 322 thereof such that the two stopper elements 311, 321 of the two pivot wing portions 31, 32 are respectively extended towards each other from the inner surfaces 312, 322 of the two pivot wing portions 31, 32, wherein the two stopper elements 311, 321 are arranged to form two stopping walls 3111, 3211 respectively (as shown in FIG. 2E) that selectively limit unfolding rotation of the two supporting arms 21, 22 about two pivot axes C1, C2 respectively and retain the two supporting arms 21, 22 in the unfolded condition in the second direction D, that is perpendicular to the holding arm 10 respectively, while having the predetermined unfolding angle A between the two supporting arms 21, 22.

According to the first preferred embodiment, the holder joint 30 is made of a metal material, for example formed by press molding, stamping die and etc., wherein a single piece of generally triangular shape metal body having a predetermined thickness is bent for the predetermined unfolding angle A (for example 60~90 degrees) to form the secure portion 33 at a bending corner portion and the two pivot wing portions 31, 32 by two halve portions of the metal body respectively. Further, the stopper elements 311, 321 are formed by cutting and bending corresponding central portions of the metal material of the two pivot wing portions 31, 32 inwardly, as shown in FIGS. 2A-2E, to form the two stopper elements 311, 321 being perpendicular to the two inner surfaces 312, 322 of the two pivot wing portions 31, 32 respectively, such that the two bent stopper elements 31, 32 311, 321 not only form the two stopping walls 3111, 3211 3121 for limiting the pivotally rotation of the two supporting arms 21, 22 about the pivot axes C1, C2 respectively, but also reinforcing the strength of the holder joint 30. It is worth mentioning that the holding arm 10 is preferred to be made of a metal round rod or other rigid material having a circular cross section and a curvature of the secure portion 33 is configured to match with the diameter of the holding arm 10 so that the mounting end portion 12 of the holding arm 10 is fittingly extended and affixed to an inner curved surface of the secure portion 33 by welding, adhering and etc., until an end surface of the holding arm 10 is biasing against the two stopper elements 311, 321, as shown in FIGS. 2D and 2E. In other words, the two stopper elements 311, 321 not only provide the stopping and limiting function for the pivotal rotation movement of the two supporting arms 22, 22 during folding and unfolding of the football holder, but also provide the stopping and limiting function for a mounting configuration of the holding arm 10 and the secure portion 33 of the holder joint 30 that further reinforces and strengthens the overall configuration of the foldable football holder of the present invention, especially during the unfolding condition when use.

In particular, each of the stopping walls 3111, 3121 3211 of the two stopper elements 311, 321 has a stopper surface, a first length extended from the inner surface 312, 322 of the pivot wing portion 31, 32 to a distal end thereof, and a second length extended between two sides of the stopper element 311, 321, such that the two supporting arms 21, 22 are capable of rotating about the pivot axis C1, C2 between the folded condition and the unfolded condition with respect to the two pivot wing portions 31, 32 of the holder joint 30 respectively, wherein when the two supporting arms 21, 22 are unfolded to the unfolded condition, a first side of each of the two supporting arms 21, 22 is stopped and biased against the stopping wall 3111, 3211 of the corresponding stopper element 311, 321.

Figure 2F:
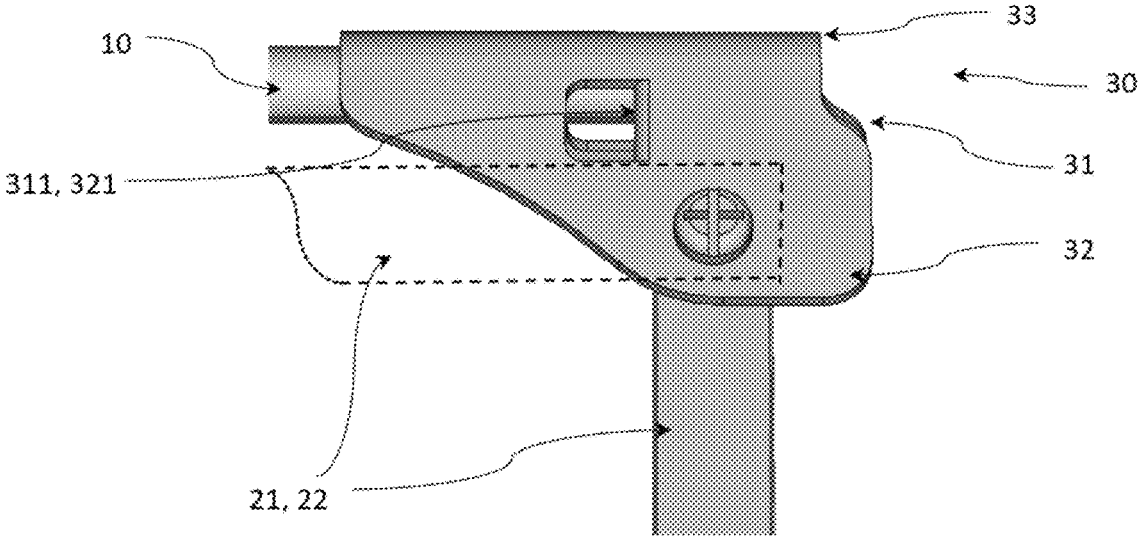
FIG. 2F is a partial schematic view illustrating the position of the supporting arm of the foldable football holder in the unfolded condition and the folded condition according to the above first preferred embodiment of the present invention.
Figure 3A:
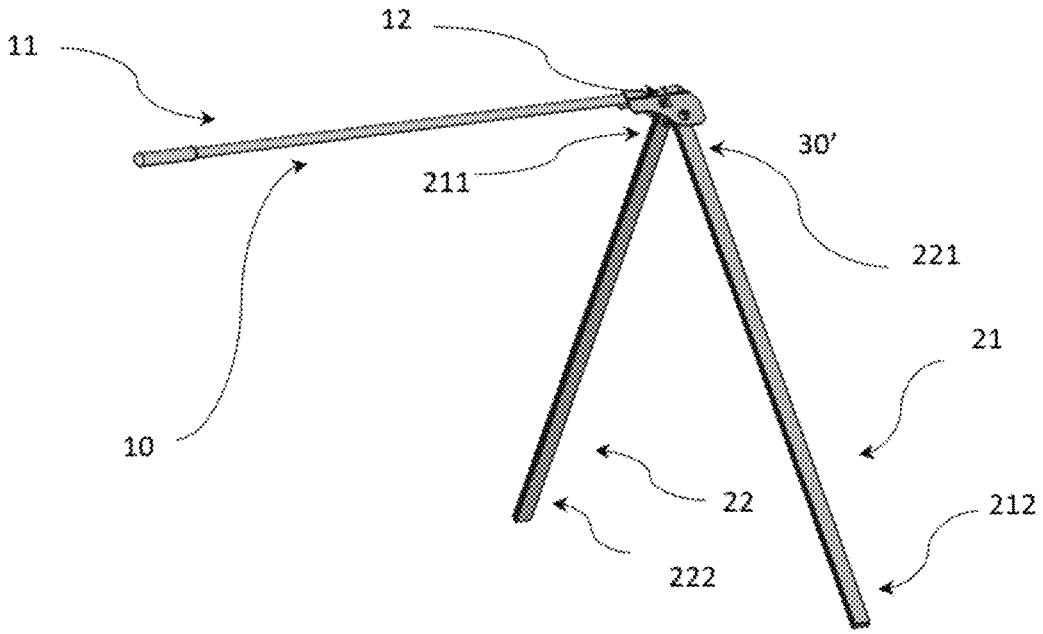
FIG. 3A is a perspective view of a foldable football holder in an unfolded condition according to a second preferred embodiment of the present invention.
Figure 3B:
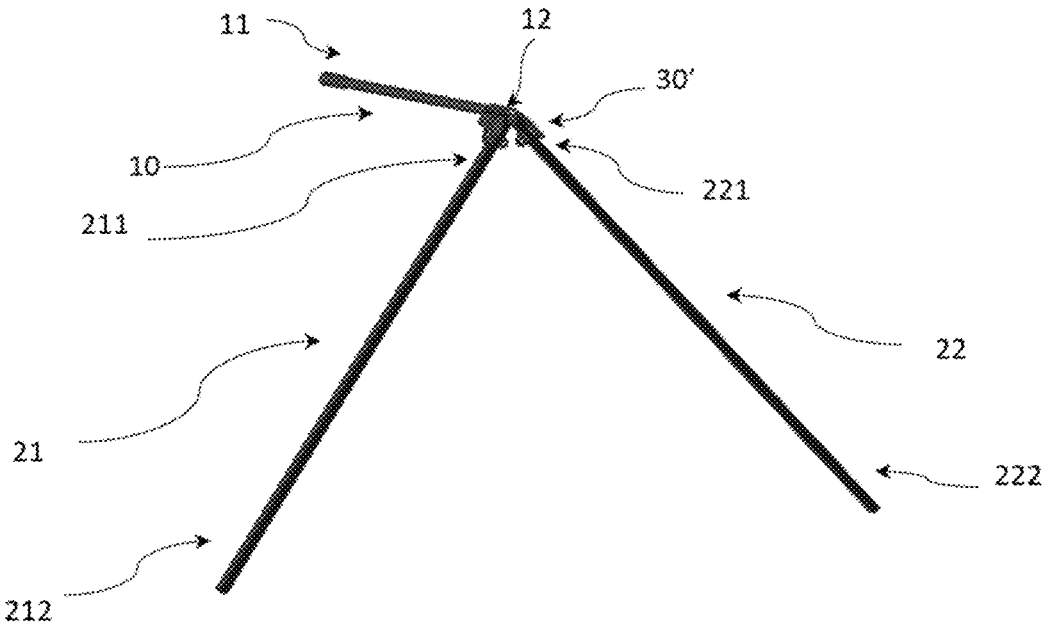
FIG. 3B is a another perspective view of the foldable football holder in the unfolded condition according to the above second preferred embodiment of the present invention.

Further, as shown in FIG. 2F, the second length of each of the stopper elements 311, 321 is predetermined to a distance between the holding arm 10 and the two supporting arms 21, 22 in the folded condition where the two supporting arms 21, 22 are rotated and folded to be parallel with the holding arm 10, so that when the two supporting arms 21, 22 are folded to the folded condition, one side of the stopper element 311, 321 substantially limits the rotation of the corresponding supporting arm 21, 22 about the pivot axis C1, C2 and retains the corresponding supporting arm 21, 22 in parallel with the holding arm 10.

Figure 1B:
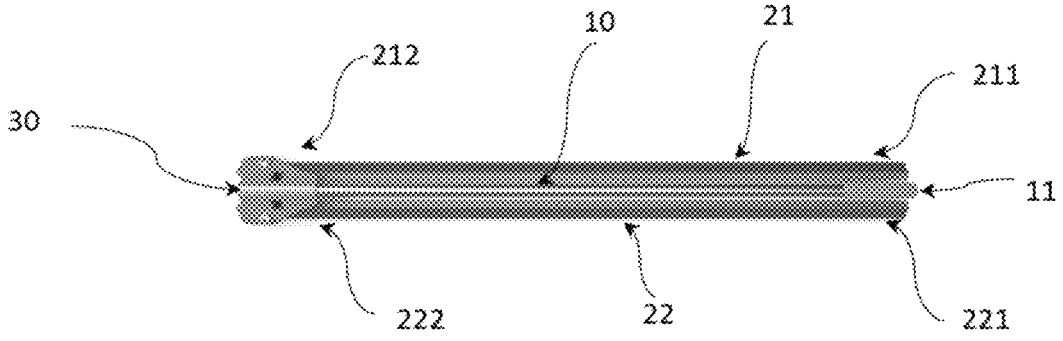
FIG. 1B is a perspective view of the foldable football holder in a folded condition according to the above first preferred embodiment of the present invention.

In other words, referring to FIGS. 1B and 2F, the two stopper elements 311, 321 of the two pivot wing portions 31, 32 of the holder joint 30 are arranged in such a manner that when the supporting arms are folded about the two pivot axes C1, C2 by rotating towards the holding arm 10, the two stopper elements 311, 312 form two stoppers to stop the rotation of the two supporting arms 21, 22 that prevents the two supporting arms from over rotation to contact with the holding arm 10 and to retain the two supporting arms 21, 22 in the folded condition, illustrated in dotted lines in FIG. 2F, that are generally parallel with the holding arm 10.

Specifically, according to the first preferred embodiment, the formation of the two stopper elements 311, 321 is an ingenious arrangement that one surface of each of two stopper elements 311, 321 of the two pivot wing portions 31, 32 of the holder joint 30 forms a stopping wall 3111, 3211 to limit folding rotation of the corresponding supporting arm 21, 22 and retain the corresponding supporting arm 21, 22 in the folded condition along the first direction D as shown in FIG. 2E, and another surface of each of the two stopper elements 311, 321 of the two pivot wing portions 31, 32 of the holder joint 30 forms an affixing wall 3112, 3212 for the secure portion 33 of the holder joint 30 that limits the mounting of the holding arm 10 in position as shown in FIG. 2D.

According to the first preferred embodiment, it is appreciated that the two stopper elements 311, 321 of the two pivot wing portions 31, 32 of the holder joint 30 are arranged in such a manner that when the two unfolded supporting arms 21, 22 are placed on a playground and the holding arm 10 is extended transversely for holding a football between the holder end portion 11 thereof and the playground, a downward reaction force applied to the holding arm 10 substantially exerts a pressing pressure against the two supporting arms 21, 22 that secures the unfolded condition of the two supporting arms 21, 22 to be retained by the two stopper elements 311, 321. The more downward pressure applied to the holding arm 10, the more secure and rigid is the unfolding configuration of the two supporting arms 21, 22 and the holding arm 10.

Referring to FIGS. 2C and 2E, the two pivot end portions 211, 221 of the two supporting arms 21, 22 are pivotally coupled with the two pivot wing portions 31, 32 of the holder joint 30 respectively in a detachable manner so that the users may assemble, disassemble and replace the supporting arms 21, 22 by themselves. According to the first preferred embodiment, the two supporting arms 21, 22 are coupled with the two pivot wing portions 31, 32 of the holder joint 30 respectively by means of a coupling means 40 comprising a bolt 41 and a nut 42 configuration, wherein each of the pivot end portions 211, 221 of the two supporting arms 21, 22 and each of the pivot wing portions 31, 32 of the holder joint 30 has a coupling hole, which center axis forms the pivot axis C1, C2, such that the bolt 41 penetrates the aligned coupling holes of the corresponding pivot wing portion 31, 32 and the pivot end portion 211, 221 and then the nut 42 can be fastened with the bolt 41 to couple the supporting arms 21, 22 with the holder joint 30. In order to allow the coupling of the two supporting arms 21, 22 with the two pivot wing portions 31, 32 of the holder joint 30, each of the coupling means 40 further comprises a pair of washers 43, made of elastic material such as plastic or silicon, being positioned at two sides of the pivot end portions 211, 221 of the two supporting arms 21, 22 respectively and being fastened by the bolt 41 and the nut 42 so as to enable the two supporting arms 21, 22 being smoothly rotating about the pivot axes C1, C2 with respect to the two pivot wing portions 31, 32 respectively. Accordingly, the user may simply unscrew the bolt 41 and the nut 42 to disassemble the coupling means 40 for replacing the corresponding supporting arm 21, 22 or fasten the bolt 41 and the nut 42 to pivotally assemble the corresponding supporting arm 21, 22 with the holder joint 30 in a rotatable manner.

In view of above, the holder joint 30 of the foldable football holder of the present invention does not require any complicated structure and additional component but is able to provide the stopping and limiting effects to the two supporting arms 21, 22 and the affixing effect to the holding arm 10 so as to provide a rigid and strengthened configuration for the foldable football holder which simplifies the manufacturing process and minimizes the manufacturing cost thereof.

Figure 4A:
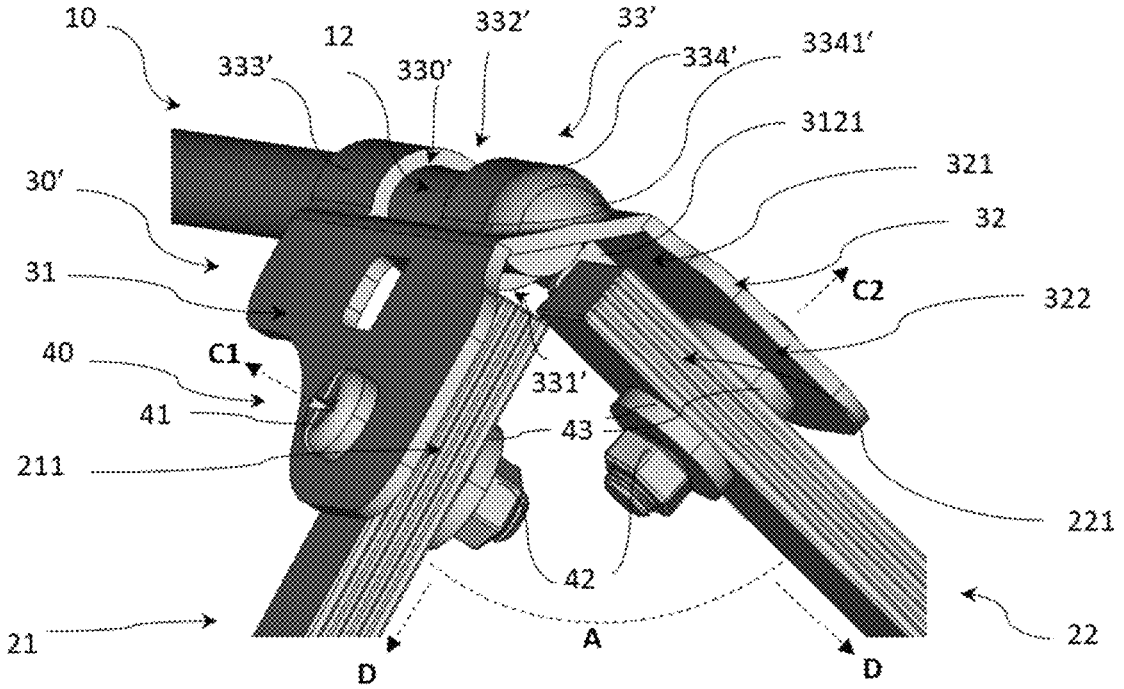
FIGS. 4A-4B are partial perspective views in different viewing angle illustrating the foldable football holder in the unfolded condition according to the above second preferred embodiment of the present invention.
Figure 4B:
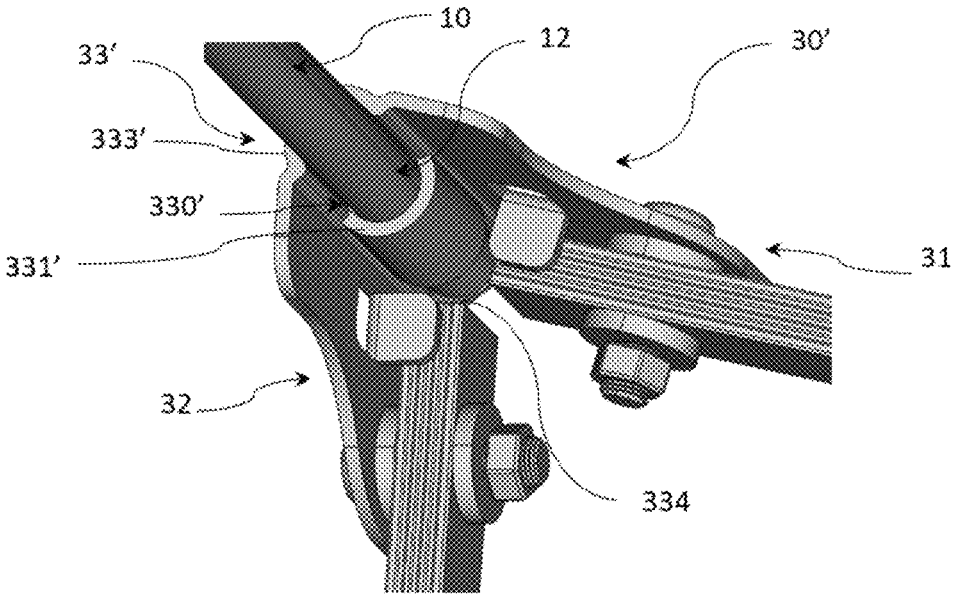

Referring to FIGS. 3A to 4B, a foldable football holder according to a second preferred embodiment of the present invention is illustrated, which holder joint 31' is modified from the first preferred embodiment as shown in FIGS. 1A to 3F to have a secure portion 33' that is configured to allow the holding arm 11 to be simply inserted and mounted in position. The secure portion 33' of the holder joint 30' according to the second preferred embodiment is integrally configured to have a semi-circular cross section having a radius equals to or slightly less than a radius of the holding arm 10. A middle segment of the secure portion 33' is cutted and depressed downwardly to form a C-shape bottom member 331', for example by stamping die, pressing mold or etc., defining a secure opening 332' while a front segment and a rear segment before and after the secure opening 332' form a C-shape front member 333' and a C-shape rear member 334' protruding upwards respectively, such that a circular securing channel 330' is defined by the front member 333' the bottom member 331' and the rear member 334 coaxially, wherein the securing channel 330' is preferred to have a diameter equal to or slight smaller than an outer diameter of the holding arm 10. The rear member 334' further has an end portion 3341 3341' forming a bottom wall of the securing channel 330'. Therefore, the mounting end portion 12 of the holding arm 10 can be simply inserted into the secure channel 330' as shown in FIGS. 4A and 4B so as to securely assemble the holding arm 10 with the holder joint 20' according to the second preferred embodiment. It is worth mentioning that the stopper elements 311, 321 of the two pivot wing portions 31, 32 of the holder joint 30' and the pivotally coupling of the two supporting arms 21, 22 with the two pivot wing portions 31, 32 of the holder joint 30' are the same as the respective disclosure of the above first preferred embodiment.

According to the second preferred embodiment, the mounting end portion 12 of the holding arm 10 is securely coupled with the secure portion 33' of the holder joint 30' in a detachable manner so that the users may assemble, disassemble and replace the holding arm by themselves.

Figure 5:
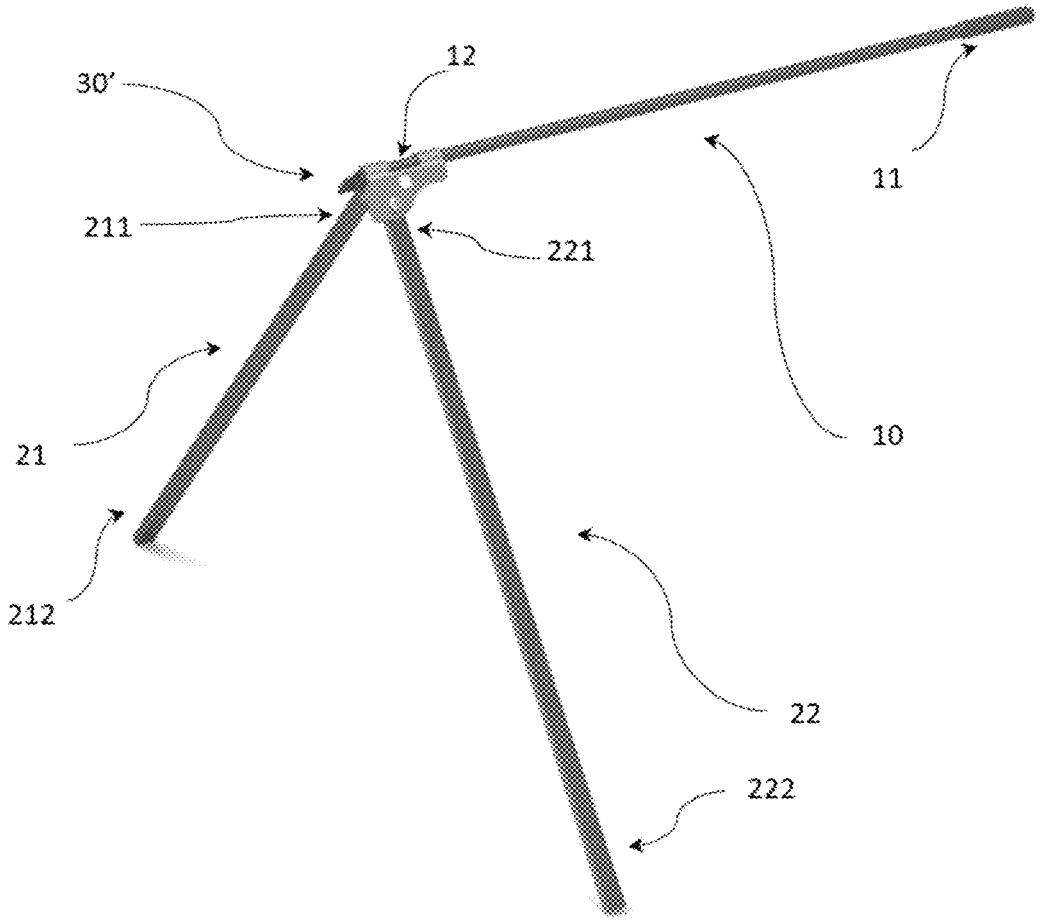
FIG. 5 is a perspective view of a foldable football holder in an unfolded condition according to a third preferred embodiment of the present invention.
Figure 6A:
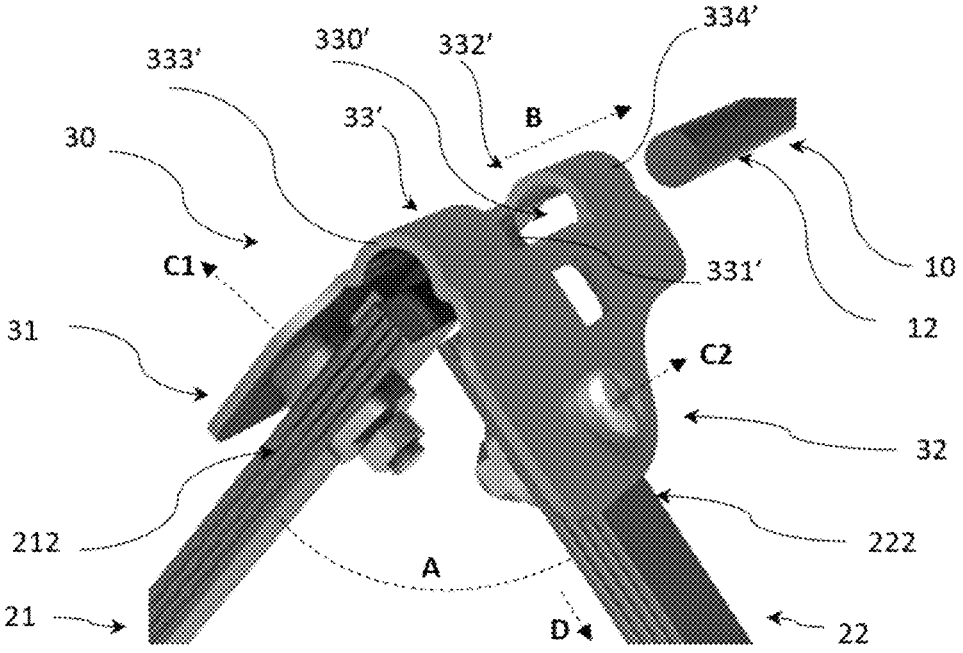
FIG. 6A is a partially exploded view of the foldable football holder in the unfolded condition according to the above third preferred embodiment of the present invention.
Figure 6B:
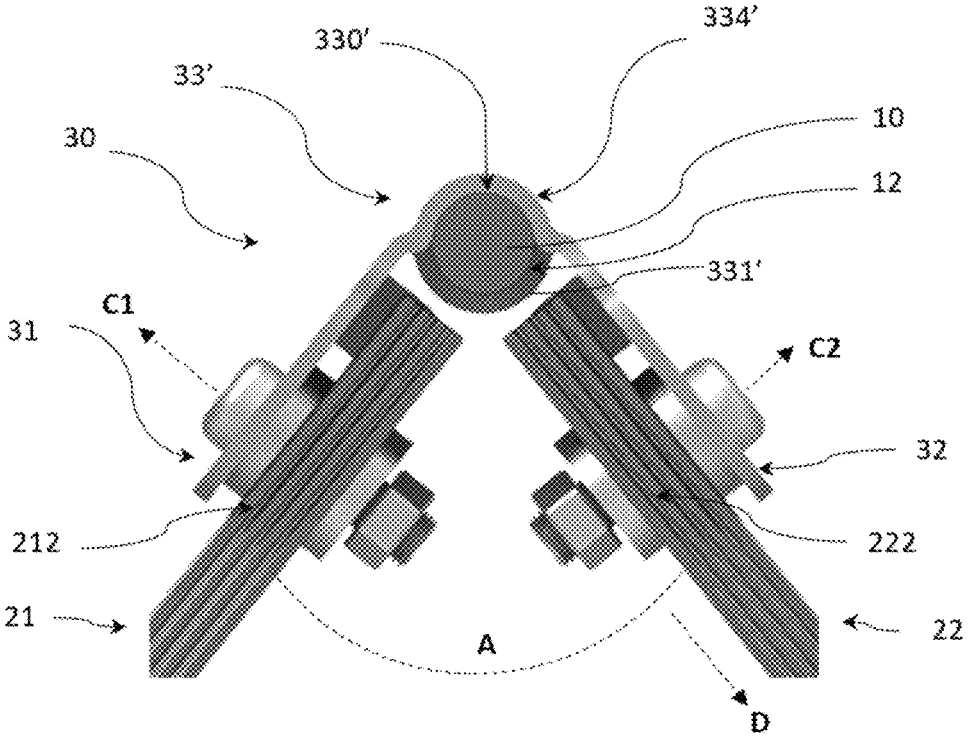
FIGS. 6B to 6D are perspective views in different viewing angle illustrating the foldable football holder in the unfolded condition according to the above third preferred embodiment of the present invention.
Figure 6C:
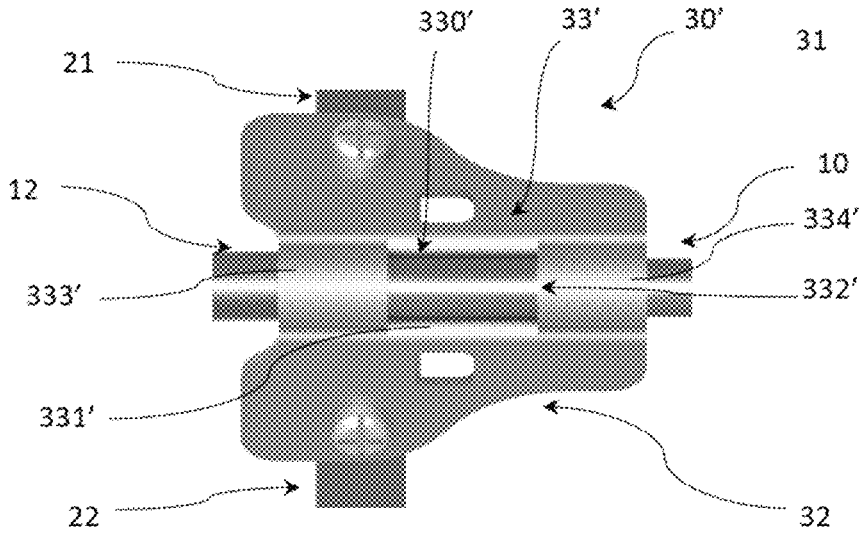
Figure 6D:
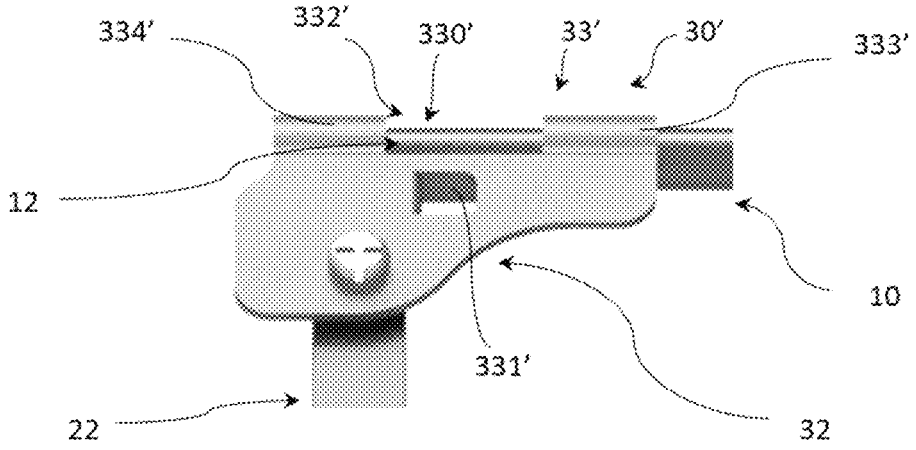
Figure 7:
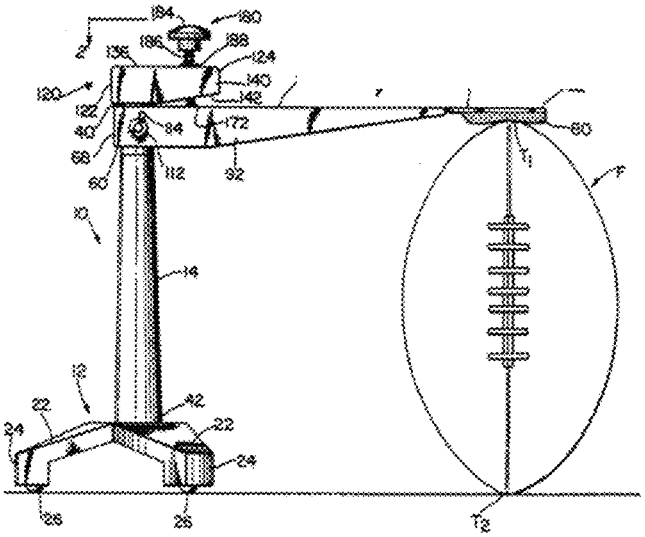
FIG. 7 PRIOR ART
FIG. 7 to FIG. 10B are patent drawings cited from prior patents of various conventional football holders.
Figure 8A:
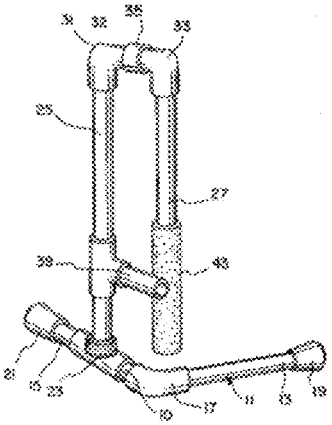
FIG. 8A PRIOR ART
Figure 8B:
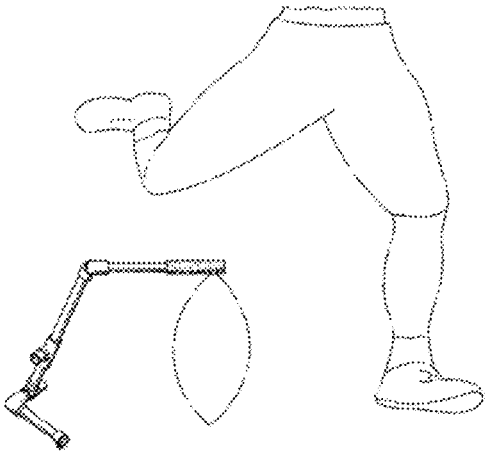
FIG. 8B PRIOR ART
Figure 9A:
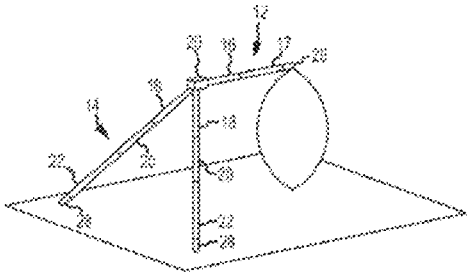
FIG. 9A PRIOR ART
Figure 9B:
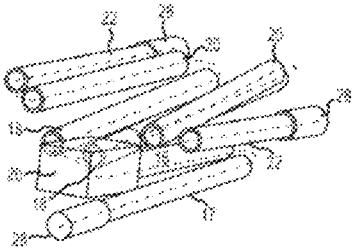
FIG. 9B PRIOR ART
Figure 10A:
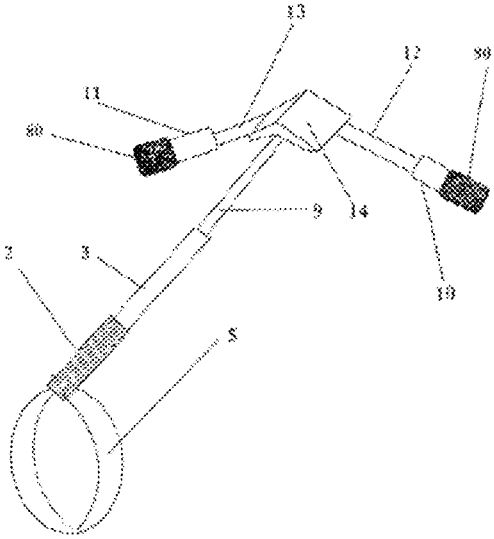
FIG. 10A PRIOR ART
Figure 10B:
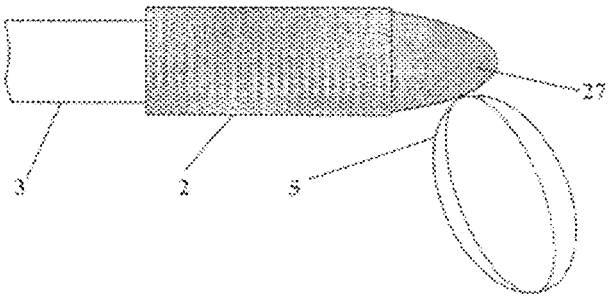
FIG. 10B PRIOR ART

Referring to FIGS. 5 to 6D, a foldable football holder according to a third preferred embodiment of the present invention is illustrated, which is a modification of the above second preferred embodiment that having the same configuration of second preferred embodiment except that the rear member 334' of the secure portion 33' does not have the end portion 3341' so that the holding arm 10 inserted into the secure channel 330' can be extended therethrough to control the length of the holding arm 10 extended from the holder joint 30'. Therefore, the user may use a longer holding arm 10 and is free to control the distance between the holding end portion 11 thereof and the holder joint 30' by allowing the mounting end portion 12 of the holding arm 10 extended rearwardly out of the rear member 334', as shown in FIG. 6C.

It should be noted that the disclosure of the above embodiments is exemplary to illustrated the inventive concept of the present invention but not for limiting the scope of the invention, wherein it is appreciated that, beside making of metal, each of the holder joint 30, 30', the supporting arms 21, 22 and the holding arm 10 can be also made of other rigid materials such as alloy, plastic, fiber plastic, wood, and etc. The holder joint 30, 30' is made of plastic by injection molding, wherein holder joint 30, 30' can be made in other shapes and the stopper elements 311, 321 can be molded directly protruded from the inner surface 312, 322 of the pivot wing portions 31, 32 and thus no hole is formed in the pivot wing portions 31, 32 as illustrated in the above embodiments.

Based on the foldable football holder as disclosed in the above embodiments as shown in FIGS. 1A to 6D, the foldable football holder can be operated to fold and unfold in the following steps:

(i) pivotally moving the two supporting arms 21, 22, which are folded in the first direction B generally parallel to the holding arm 10 securely coupled to the holder joint 30, 30', away from the holding arm 10 to unfold the two supporting arms 21, 22 until two pivot end portions 211, 221 of the two supporting arms 21, 22 pivotally, until the pivot end portions 211, 221 of the two supporting arms 21, 22 are limited and stopped the two stopping elements 311, 321 respectively, to an unfolded position that the two supporting arms 21, 22 are extended in the second direction D, generally perpendicular to the holding arm 10 with the predetermined unfolding angle A defined between the two supporting arms 21, 22, such that the two supporting arms 21, 22 are in an inverted V-shape and adapted to place on a playground while the holding arm 10 is transversely extended parallel to the playground for holding a football between the holding end portion 11 of the holding arm 10 and the playground, wherein a downward reaction force applied to the holding arm 10 substantially exerts a pressing pressure against the two supporting arms 21, 22 that secures the unfolded condition of the two supporting arms 21, 22 to be retained by the two stopper elements 311, 321; and (ii) pivotally moving the two supporting arms 21, 22 from the unfolded condition towards the holding arm 10 until the two supporting arms 21, 22 are in the first direction B, generally parallel to the holding arm 10, so as to folded the two supporting arms 21, 22 back to the folded condition for ease of storage and carrying.

One skilled in the art will understand that the embodiment of the present invention as shown in the drawings and described above is exemplary only and not intended to be limiting.

It will thus be seen that the objects of the present invention have been fully and effectively accomplished. The embodiments have been shown and described for the purposes of illustrating the functional and structural principles of the present invention and is subject to change without departure from such principles. Therefore, this invention includes all modifications encompassed within the spirit and scope of the following claims.

What is claimed is:

1. A foldable football holder, comprising:

at least two elongated supporting arms, each having a support end portion and a pivot end portion;

an elongated holding arm, having a holding end portion and a mounting end portion; and a holder joint, having a general V-shaped configuration, configured to have a secure portion and two pivot wing portions integrally extended from two opposing sides of the secure portion respectively with a predetermined unfolding angle therebetween, wherein the mounting end portion of the holding arm is securely coupled with the secure portion of the holder joint while the holding end portion of the holding arm is extended away from the holder joint in a first direction and the pivot end portions of the two supporting arm are rotatably coupled with the two pivot wing portions of the holder joint about two pivot axes respectively in such a manner that the two supporting arms are capable of selectively rotating about the two pivot axes to a folded condition that the support end portions of the two supporting arms are extended towards the first direction and to a unfolded condition that the support end portions of the two supporting arms are extended towards a second direction while having the unfolding angle between the two supporting arms, wherein each of the two pivot wing portions has a stopper element protruded from an inner surface of each of the two pivot wing portions, such that the two stopper elements of the two pivot wing portions are respectively extended towards each other from the inner surfaces of the two pivot wing portions, wherein the two stopper elements are arranged to form two stopping walls that selectively limit unfolding rotation of the two supporting arms about the two pivot axes respectively and retain the two supporting arms in the unfolded condition in the second direction, that is perpendicular to the holding arm respectively, while having the predetermined unfolding angle between the two supporting arms.

2. The foldable football holder, as recited in claim 1, wherein the two stopper elements of the two pivot wing portions of the holder joint are arranged in such a manner that a downward reaction force applied to the holding arm substantially exerts a pressing pressure against the two supporting arms when the two unfolded supporting arms are placed on a playground and the holding arm is extended transversely for holding a football between the holder end portion thereof and the playground, so as to secure the unfolded condition of the two supporting arms to be retained by the two stopper elements.

3. The foldable football holder, as recited in claim 1, wherein the two stopper elements of the two pivot wing portions of the holder joint are arranged in such a manner that the two stopper elements form stoppers to stop the rotation of the two supporting arms respectively when the supporting arms are folded about the two pivot axes by rotating towards the holding arm, so as to prevent the two supporting arms from over rotation to contact with the holding arm and to retain the two supporting arms in the folded condition that are generally parallel with the holding arm.

4. The foldable football holder, as recited in claim 2, wherein the two stopper elements of the two pivot wing portions of the holder joint are arranged in such a manner that the two stopper elements form stoppers to stop the rotation of the two supporting arms respectively when the supporting arms are folded about the two pivot axes by rotating towards the holding arm, so as to prevent the two supporting arms from over rotation to contact with the holding arm and to retain the two supporting arms in the folded condition that are generally parallel with the holding arm.

5. The foldable football holder, as recited in claim 1, wherein each of the two stopper elements of the two pivot wing portions has a stopper wall, wherein each of the two stopping walls of the two stopper elements has a stopper surface, a first length extended from the inner surface of the pivot wing portion to a distal end thereof, and a second length extended between two sides of the stopper element, such that the two supporting arms are capable of rotating about the pivot axes between the folded condition and the unfolded condition with respect to the two pivot wing portions of the holder joint respectively, wherein when the two supporting arms are unfolded to the unfolded condition, a first side of each of the two supporting arms is stopped and biased against the stopper surface of the corresponding stopper element.

6. The foldable football holder, as recited in claim 2, wherein each of the two stopper elements of the two pivot wing portions has a stopper wall, wherein each of the two stopping walls of the two stopper elements has a stopper surface, a first length extended from the inner surface of the pivot wing portion to a distal end thereof, and a second length extended between two sides of the stopper element, such that the two supporting arms are capable of rotating about the pivot axes between the folded condition and the unfolded condition with respect to the two pivot wing portions of the holder joint respectively, wherein when the two supporting arms are unfolded to the unfolded condition, a first side of each of the two supporting arms is stopped and biased against the stopper surface of the corresponding stopper element.

7. The foldable football holder, as recited in claim 3, wherein each of the two stopper elements of the two pivot wing portions has a stopper wall, wherein each of the two stopping walls of the two stopper elements has a stopper surface, a first length extended from the inner surface of the pivot wing portion to a distal end thereof, and a second length extended between two sides of the stopper element, such that the two supporting arms are capable of rotating about the pivot axes between the folded condition and the unfolded condition with respect to the two pivot wing portions of the holder joint respectively, wherein when the two supporting arms are unfolded to the unfolded condition, a first side of each of the two supporting arms is stopped and biased against the stopper surface of the corresponding stopper element.

8. The foldable football holder, as recited in claim 4, wherein each of the two stopper elements of the two pivot wing portions has a stopper wall, wherein each of the two stopping walls of the two stopper elements has a stopper surface, a first length extended from the inner surface of the pivot wing portion to a distal end thereof, and a second length extended between two sides of the stopper element, such that the two supporting arms are capable of rotating about the pivot axes between the folded condition and the unfolded condition with respect to the two pivot wing portions of the holder joint respectively, wherein when the two supporting arms are unfolded to the unfolded condition, a first side of each of the two supporting arms is stopped and biased against the stopper surface of the corresponding stopper element.

9. The foldable football holder, as recited in claim 5, wherein the second length of each of the stopper elements is predetermined to a distance between the holding arm and the two supporting arms in the folded condition where the two supporting arms are rotated and folded to be parallel with the holding arm, so that when the two supporting arms are folded to the folded condition, one side of each of the stopper elements substantially limits the rotation of the corresponding supporting arm about the corresponding pivot axis and retains the corresponding supporting arm in parallel with the holding arm.

10. The foldable football holder, as recited in claim 6, wherein the second length of each of the stopper elements is predetermined to a distance between the holding arm and the two supporting arms in the folded condition where the two supporting arms are rotated and folded to be parallel with the holding arm, so that when the two supporting arms are folded to the folded condition, one side of each of the stopper elements substantially limits the rotation of the corresponding supporting arm about the corresponding pivot axis and retains the corresponding supporting arm in parallel with the holding arm.

11. The foldable football holder, as recited in claim 7, wherein the second length of each of the stopper elements is predetermined to a distance between the holding arm and the two supporting arms in the folded condition where the two supporting arms are rotated and folded to be parallel with the holding arm, so that when the two supporting arms are folded to the folded condition, one side of each of the stopper elements substantially limits the rotation of the corresponding supporting arm about the corresponding pivot axis and retains the corresponding supporting arm in parallel with the holding arm.

12. The foldable football holder, as recited in claim 8, wherein the second length of each of the stopper elements is predetermined to a distance between the holding arm and the two supporting arms in the folded condition where the two supporting arms are rotated and folded to be parallel with the holding arm, so that when the two supporting arms are folded to the folded condition, one side of each of the stopper elements substantially limits the rotation of the corresponding supporting arm about the corresponding pivot axis and retains the corresponding supporting arm in parallel with the holding arm.

13. The foldable football holder, as recited in claim 1, wherein the two pivot end portions of the two supporting arms are pivotally coupled with the two pivot wing portions of the holder joint respectively in a detachable manner.

14. The foldable football holder, as recited in claim 2, wherein the two pivot end portions of the two supporting arms are pivotally coupled with the two pivot wing portions of the holder joint respectively in a detachable manner.

15. The foldable football holder, as recited in claim 1, wherein the holding arm is an elongated rod having a circular cross section and the secure portion of the holder joint is integrally configured to have a semi-circular cross section and a curvature of the secure portion is configured to match with a diameter of the holding arm, such that the holding arm is securely affixed to the secure portion of the holder joint to retain in the predetermined unfolding angle therebetween, wherein a middle segment of the secure portion is depressed downwardly to form a bottom member while a front segment and a rear segment before and after the secure opening form a C-shape front member and a C-shape rear member protruding upwards respectively, such that a circular securing channel is defined by the front member, the bottom member and the rear member coaxially, wherein the securing channel has a diameter equal to or slightly smaller than an outer diameter of the holding arm, wherein the mounting end portion of the holding arm is inserted in the securing channel so as to couple the holding arm with the holder joint.

16. The foldable football holder, as recited in claim 2, wherein the holding arm is an elongated rod having a circular cross section and the secure portion of the holder joint is integrally configured to have a semi-circular cross section and a curvature of the secure portion is configured to match with a diameter of the holding arm, such that the holding arm is securely affixed to the secure portion of the holder joint to retain in the predetermined unfolding angle therebetween, wherein a middle segment of the secure portion is depressed downwardly to form a bottom member while a front segment and a rear segment before and after the secure opening form a C-shape front member and a C-shape rear member protruding upwards respectively, such that a circular securing channel is defined by the front member, the bottom member and the rear member coaxially, wherein the securing channel has a diameter equal to or slightly smaller than an outer diameter of the holding arm, wherein the mounting end portion of the holding arm is inserted in the securing channel so as to couple the holding arm with the holder joint.

17. The foldable football holder, as recited in claim 5, the holding arm is an elongated rod having a circular cross section and the secure portion of the holder joint is integrally configured to have a semi-circular cross section and a curvature of the secure portion is configured to match with a diameter of the holding arm, such that the holding arm is securely affixed to the secure portion of the holder joint to retain in the predetermined unfolding angle therebetween, wherein a middle segment of the secure portion is depressed downwardly to form a bottom member while a front segment and a rear segment before and after the secure opening form a C-shape front member and a C-shape rear member protruding upwards respectively, such that a circular securing channel is defined by the front member, the bottom member and the rear member coaxially, wherein the securing channel has a diameter equal to or slightly smaller than an outer diameter of the holding arm, wherein the mounting end portion of the holding arm is inserted in the securing channel so as to couple the holding arm with the holder joint.

18. The foldable football holder, as recited in claim 6, the holding arm is an elongated rod having a circular cross section and the secure portion of the holder joint is integrally configured to have a semi-circular cross section and a curvature of the secure portion is configured to match with a diameter of the holding arm, such that the holding arm is securely affixed to the secure portion of the holder joint to retain in the predetermined unfolding angle therebetween, wherein a middle segment of the secure portion is depressed downwardly to form a bottom member while a front segment and a rear segment before and after the secure opening form a C-shape front member and a C-shape rear member protruding upwards respectively, such that a circular securing channel is defined by the front member, the bottom member and the rear member coaxially, wherein the securing channel has a diameter equal to or slightly smaller than an outer diameter of the holding arm, wherein the mounting end portion of the holding arm is inserted in the securing channel so as to couple the holding arm with the holder joint.

19. The foldable football holder, as recited in claim 12, the holding arm is an elongated rod having a circular cross section and the secure portion of the holder joint is integrally configured to have a semi-circular cross section and a curvature of the secure portion is configured to match with a diameter of the holding arm, such that the holding arm is securely affixed to the secure portion of the holder joint to retain in the predetermined unfolding angle therebetween, wherein a middle segment of the secure portion is depressed downwardly to form a bottom member while a front segment and a rear segment before and after the secure opening form a C-shape front member and a C-shape rear member protruding upwards respectively, such that a circular securing channel is defined by the front member, the bottom member and the rear member coaxially, wherein the securing channel has a diameter equal to or slightly smaller than an outer diameter of the holding arm, wherein the mounting end portion of the holding arm is inserted in the securing channel so as to couple the holding arm with the holder joint.

* * * * *